US011164695B2

(12) United States Patent
Otsubo et al.

(10) Patent No.: US 11,164,695 B2
(45) Date of Patent: Nov. 2, 2021

(54) INDUCTOR COMPONENT

(71) Applicant: Murata Manufacturing Co., Ltd., Kyoto (JP)

(72) Inventors: Yoshihito Otsubo, Kyoto (JP); Shinichiro Banba, Kyoto (JP); Mitsuyoshi Nishide, Kyoto (JP); Norio Sakai, Kyoto (JP); Haruhiko Mori, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 1028 days.

(21) Appl. No.: 15/809,208

(22) Filed: Nov. 10, 2017

(65) Prior Publication Data

US 2018/0090263 A1 Mar. 29, 2018

Related U.S. Application Data

(63) Continuation of application No. PCT/JP2016/063829, filed on May 10, 2016.

(30) Foreign Application Priority Data

May 13, 2015 (JP) ..... JP2015-098064

(51) Int. Cl.
*H01F 27/32* (2006.01)
*H01F 17/00* (2006.01)
(Continued)

(52) U.S. Cl.
CPC ..... *H01F 27/32* (2013.01); *H01F 17/0013* (2013.01); *H01F 17/0033* (2013.01);
(Continued)

(58) Field of Classification Search
CPC .. H01F 27/32; H01F 17/0033; H01F 17/0013; H01F 27/24; H01F 27/28; H01F 2017/002
See application file for complete search history.

(56) References Cited

U.S. PATENT DOCUMENTS 7,339,452 B2 * 3/2008 Lee ..... H01F 17/0013 336/200
7,817,440 B2 * 10/2010 Kariya ..... H05K 1/18 361/763

(Continued)

FOREIGN PATENT DOCUMENTS

JP 5270576 B2 8/2013
JP 2014-038884 A 2/2014

OTHER PUBLICATIONS

International Search Report Issued in Patent Application No. PCT/JP2016/063829 dated Jun. 7, 2016.

(Continued)

*Primary Examiner* — Mang Tin Bik Lian
(74) *Attorney, Agent, or Firm* — Pearne & Gordon LLP

(57) ABSTRACT

A first resin layer (resin insulating layer) is formed by forming first and third covering portions in close contact with peripheral surfaces of respective end portions of first and second metal pins on the side closer to first end surfaces thereof, and by forming a body portion in a state of covering the respective surfaces of the first and third covering portions. Therefore, even when the first resin layer is thermally contracted, boundary regions of the one principal surface of the first resin layer around the respective end portions of the first and second metal pins on the side closer to the first end surfaces are filled with the first and third covering portions. Hence gaps can be prevented from being generated in those (Continued)

boundary regions, and a columnar conductor (first metal pin) can be avoided from deviating in position.

16 Claims, 9 Drawing Sheets

(51) Int. Cl.
*H01F 27/28* (2006.01)
*H01F 27/24* (2006.01)

(52) U.S. Cl.
CPC ..... *H01F 27/24* (2013.01); *H01F 27/28* (2013.01); *H01F 2017/002* (2013.01)

(56) References Cited

U.S. PATENT DOCUMENTS

| | | | | |
|---|---|---|---|---|
| 8,581,114 | B2 * | 11/2013 | Harrison | H05K 1/165 174/266 |
| 2009/0077791 | A1 * | 3/2009 | Quilici | H01F 17/0033 29/602.1 |
| 2014/0159851 | A1 * | 6/2014 | Mano | H01F 17/0013 336/200 |
| 2015/0348695 | A1 * | 12/2015 | Kostelnik | H01F 41/046 336/200 |
| 2016/0086709 | A1 * | 3/2016 | Quilici | H05K 1/165 336/200 |

OTHER PUBLICATIONS

Written Opinion Issued in Patent Application No. PCT/JP2016/063829 dated Jun. 7, 2016.

* cited by examiner

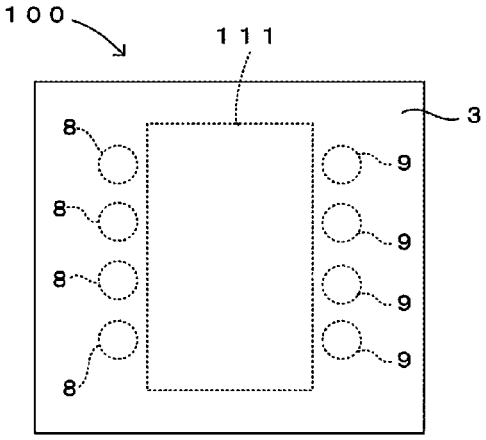
FIG. 8A
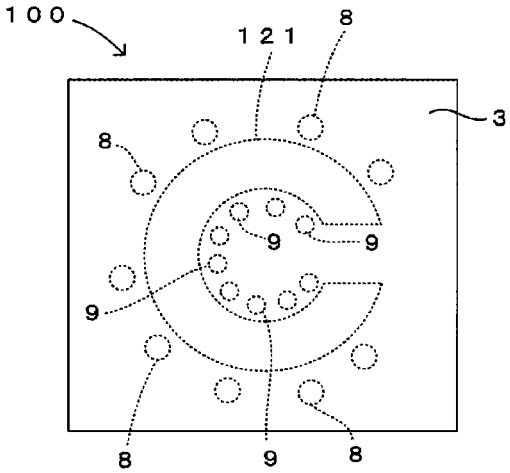
FIG. 8B
FIG. 9
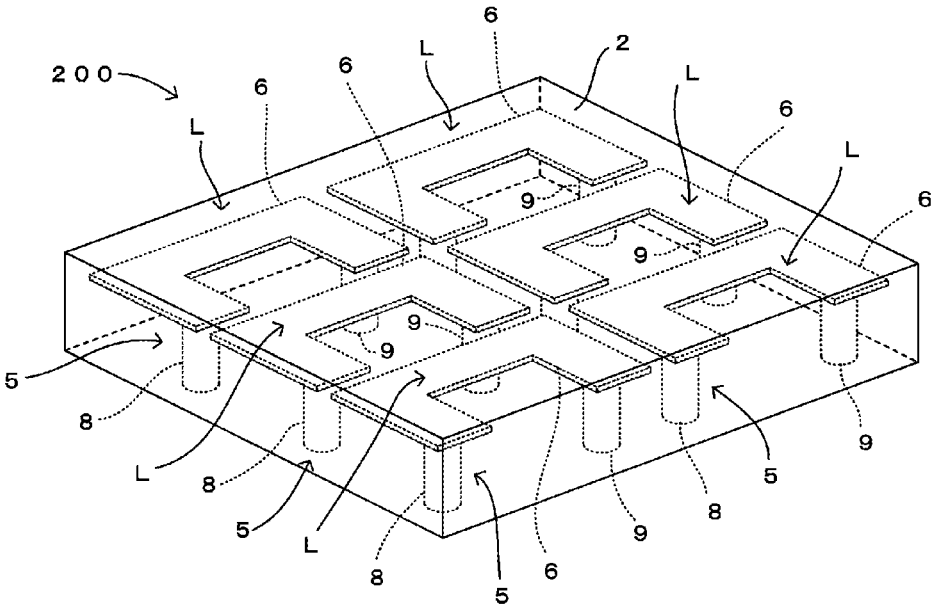

INDUCTOR COMPONENT

This is a continuation of International Application No. PCT/JP2016/063829 filed on May 10, 2016 which claims priority from Japanese Patent Application No. 2015-098064 filed on May 13, 2015. The contents of these applications are incorporated herein by reference in their entireties.

BACKGROUND OF THE DISCLOSURE

Field of the Disclosure

The present disclosure relates to an inductor component including an inductor disposed on or in a resin insulating layer.

Description of the Related Art

Hitherto, an inductor component 500 including a transformer constituted therein, as illustrated in FIG. 10, has been proposed (see Patent Document 1). The inductor component 500 includes a coil core 501 buried in a resin insulating layer, a first inductor electrode 502*a* forming a primary coil, and a second inductor electrode 502*b* forming a secondary coil. The first and second inductor electrodes 502*a* and 502*b* include respectively first and second outer columnar conductors 503*a* and 503*b* that are arrayed along an outer peripheral surface of the coil core 501, and first and second inner columnar conductors 504*a* and 504*b* that are arrayed along an inner peripheral surface of the coil core 501.

Respective ends of the first outer columnar conductors 503*a* and the first inner columnar conductors 504*a*, those ends being positioned in a corresponding relation, are connected to each other by a plurality of first wiring electrode patterns 505*a* that are formed on or in both principal surfaces of the resin insulating layer, whereby the first inductor electrode 502*a* is formed in a state spirally wound around the coil core 501. Moreover, respective ends of the second outer columnar conductors 503*b* and the second inner columnar conductors 504*b*, those ends being positioned in a corresponding relation, are connected to each other by a plurality of second wiring electrode patterns 505*b* that are formed on or in both the principal surfaces of the resin insulating layer, whereby the second inductor electrode 502*b* is formed in a state spirally wound around the coil core 501.

The first and second inductor electrodes 502*a* and 502*b* include respectively primary and secondary coil electrode pairs 506*a* and 506*b*, and primary and secondary coil center taps 507*a* and 507*b*. In FIG. 10, the second wiring electrode patterns 505*b*, the secondary coil electrode pair 506*b*, and the secondary coil center tap 507*b*, which cooperatively form the secondary coil, are each drawn with hatching.

Patent Document 1: Japanese Patent No. 5270576 (Paragraphs 0044 to 0046, FIG. 3, etc.)

BRIEF SUMMARY OF THE DISCLOSURE

In the above-described inductor component 500, after the first and second outer columnar conductors 503*a* and 503*b* and the first and second inner columnar conductors 504*a* and 504*b* have been arranged at predetermined positions, the resin insulating layer is formed by filling a resin so as to cover respective outer peripheral surfaces of the columnar conductors 503*a*, 503*b*, 504*a* and 504*b*. At that time, because the filled resin is contracted when it is thermally cured, gaps may be caused in some cases at boundaries between the resin insulating layer and the respective ends of the columnar conductors 503*a*, 503*b*, 504*a* and 504*b*, those ends being exposed at a surface of the resin insulating layer. In such a case, there is a risk that moisture, etc. may enter the interior of the inductor component 500 through the gaps, and that characteristics of the inductor component 500 may degrade. As another risk, it may be difficult to interconnect the columnar conductors due to tilting, falling, positional deviation, etc. of the columnar conductors.

The present disclosure has been accomplished in view of the problems described above, and an object of the present disclosure is to provide a technique capable of preventing a gap from being generated in a boundary region of one principal surface of the resin insulating layer around an end portion of a first metal pin on the side closer to a first end surface of the first metal pin, and capable of avoiding positional deviation of columnar conductors.

To achieve the above object, the present disclosure provides an inductor component including a resin insulating layer, and an inductor including a first metal pin that is buried in the resin insulating layer, wherein a first end surface of the first metal pin is exposed at one principal surface of the resin insulating layer, and wherein the resin insulating layer includes a first covering portion that covers a part of a lateral surface of the first metal pin, the part being positioned close to the first end surface of the first metal pin, and that has a first flat surface exposed at a part of the one principal surface of the resin insulating layer, the part surrounding the first end surface of the first metal pin, and a body portion that covers a surface of the first covering portion except for the first flat surface.

According to the present disclosure thus constituted, the resin insulating layer is formed in such a state that the first covering portion is formed in close contact with a peripheral surface of an end portion of the first metal pin on the side closer to the first end surface thereof, and that the body portion covers the surface of the first covering portion. Therefore, even when the resin insulating layer is thermally contracted, a boundary region of the one principal surface of the resin insulating layer around the end portion of the first metal pin on the side closer to the first end surface thereof is filled with the first covering portion, and a gap can be prevented from being generated in the above-mentioned boundary region. In addition, since a columnar conductor (first metal pin) is more positively fixed by the first covering portion, the columnar conductor can be avoided from deviating in position.

Preferably, the first covering portion is formed in thickness gradually increasing toward the first flat surface.

That feature is realized by causing resin to creep over along the peripheral surface of the first metal pin from the side closer to the first end surface thereof due to wetting. As a result, the first covering portion can be easily formed in a close contact state with the peripheral surface of the first metal pin.

The first metal pin may be buried in the resin insulating layer with a second end surface of the first metal pin being exposed at the other principal surface of the resin insulating layer, and the resin insulating layer may further include a second covering portion that covers a part of the lateral surface of the first metal pin, the part being positioned close to the second end surface of the first metal pin, and that has a second flat surface exposed at a part of the other principal surface of the resin insulating layer, the part surrounding the second end surface of the first metal pin, and the body portion that covers a surface of the second covering portion except for the second flat surface.

With those features, as in the case of including the first covering portion, a gap can be prevented by the second covering portion from being generated in a boundary region of the other principal surface of the resin insulating layer around the end portion of the first metal pin on the side closer to the second end surface thereof. In addition, the columnar conductor (first metal pin) can be avoided from deviating in position.

Preferably, thermal conductivity of the first covering portion is larger than thermal conductivity of the body portion.

With that feature, heat generated in a region of the end portion of the first metal pin on the side closer to the first end surface thereof can be efficiently released to the outside through the first covering portion.

The inductor may further include a second metal pin that is buried in the resin insulating layer with a first end surface of the second metal pin being exposed at the one principal surface of the resin insulating layer, and a connecting conductor that is arranged on or in the one principal surface of the resin insulating layer, and that is connected to the first end surface of the first metal pin and the first end surface of the second metal pin.

With that feature, the inductor component including the inductor of a practical structure, namely the inductor formed by the first metal pin, the second metal pin, and the connecting conductor, can be provided.

Preferably, the inductor component further includes a resin protective layer that is formed on the one principal surface of the resin insulating layer in a state of covering the connecting conductor, and thermal conductivity of the resin protective layer is larger than thermal conductivity of the body portion.

With those features, heat generated in a connection region between each of the first metal pin and the second metal pin and the connecting conductor can be efficiently released to the outside through the resin protective layer.

Preferably, the inductor component further includes a coil core that is arranged between the first metal pin and the second metal pin, and that is buried in the body portion.

With that feature, since the coil core is arranged between the first and second metal pins, an inductance of the inductor included in the inductor component can be increased.

The resin insulating layer may further include a third covering portion that covers a part of a lateral surface of the second metal pin, the part being positioned close to the first end surface of the second metal pin, and that has a third flat surface exposed at a part of the one principal surface of the resin insulating layer, the part surrounding the first end surface of the second metal pin, and a coupling portion that is in the form of a layer, that has a flat surface forming the same plane as defined by the first flat surface and the third flat surface, and that couples the first covering portion and the third covering portion integrally with each other.

With that feature, gaps can be prevented from being generated in the boundary regions of the one principal surface of the resin insulating layer around the respective end portions of the first metal pin and the second metal pin on the side closer to the first end surface thereof with the presence of the first covering portion and the third covering portion that are coupled integrally with each other by the coupling portion in the form of a layer.

Preferably, the body portion is exposed at a part of the one principal surface of the resin insulating layer, the part surrounding the first flat surface of the first covering portion.

To obtain that feature, the one principal surface of the resin insulating layer in which the first metal pin is buried is partly removed by grinding or cutting to such an extend that the body portion is exposed at the part surrounding the first flat surface of the first covering portion. Therefore, flatness of the one principal surface of the resin insulating layer can be improved and a height of the first metal pin can be accurately adjusted. As a result, the inductor can be formed with high accuracy.

Preferably, the curing of resin of the first covering portion is more promoted than the curing of resin of the body portion.

With that feature, positional deviation of the first metal pin can be effectively prevented with the presence of the first covering portion cured in the more promoted state.

According to the present disclosure, since the first covering portion is formed in close contact with the peripheral surface of the end portion of the first metal pin on the side closer to the first end surface thereof, a gap can be prevented from being generated in the boundary region of the one principal surface of the resin insulating layer around the end portion of the first metal pin on the side closer to the first end surface thereof.

BRIEF DESCRIPTION OF THE SEVERAL VIEWS OF THE DRAWINGS

Each of FIGS. 2A to 2C is a sectional view of the inductor component illustrated in FIG. 1; specifically.

Each of FIGS. 3A to 3G illustrates one example of a manufacturing method for the inductor component illustrated in FIG. 1; specifically.

Each of FIGS. 4A to 4D illustrates another example of the manufacturing method for the inductor component illustrated in FIG. 1; specifically.

Each of FIGS. 8A and 8B illustrates modifications of a coil core; specifically, FIG. 8A illustrates a coil core having a linear shape, and FIG. 8B illustrates a coil core having a substantially C-like shape.

FIG. 9 is a perspective view of an inductor component according to a fourth embodiment of the present disclosure.

DETAILED DESCRIPTION OF THE DISCLOSURE

First Embodiment

Figure 1:
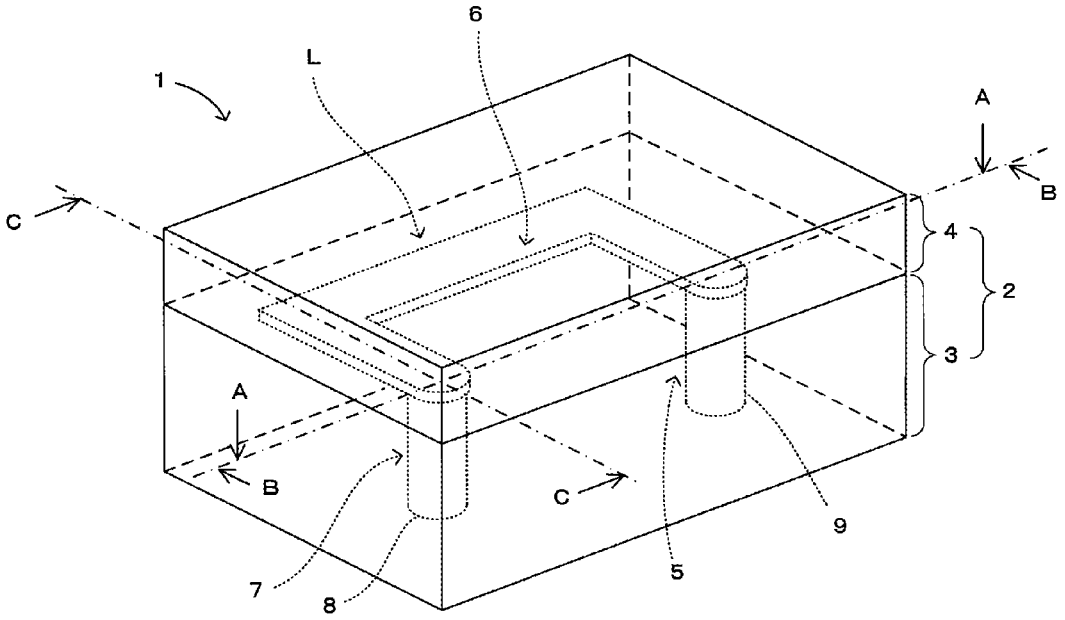
FIG. 1 is a perspective view of an inductor component according to a first embodiment of the present disclosure.
Figure 2A:
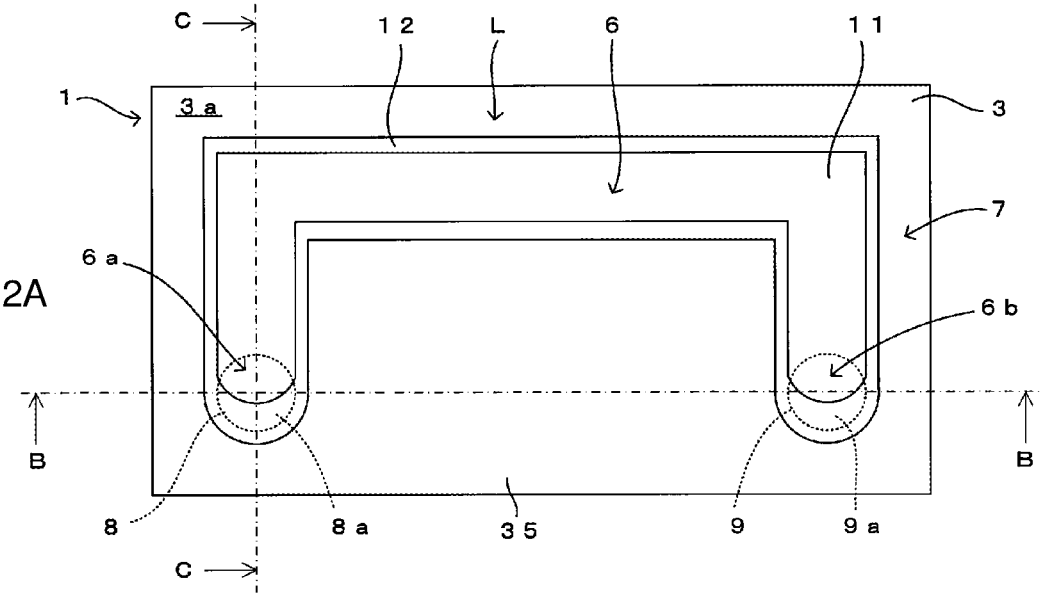
FIG. 2A is a sectional view taken along a line A-A in FIG. 1 when viewed in a direction denoted by arrow.
Figure 2B:
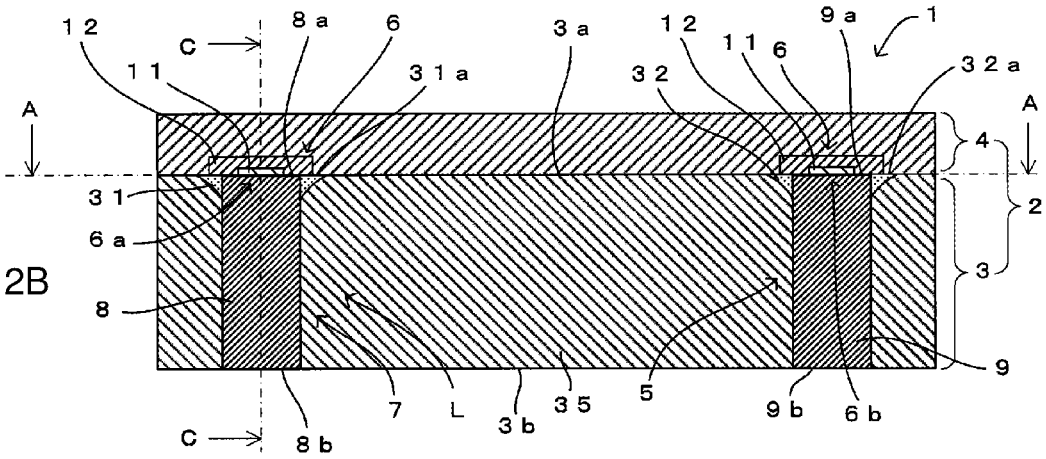
FIG. 2B is a sectional view taken along a line B-B in FIG. 1 when viewed in a direction denoted by arrow.
Figure 2C:
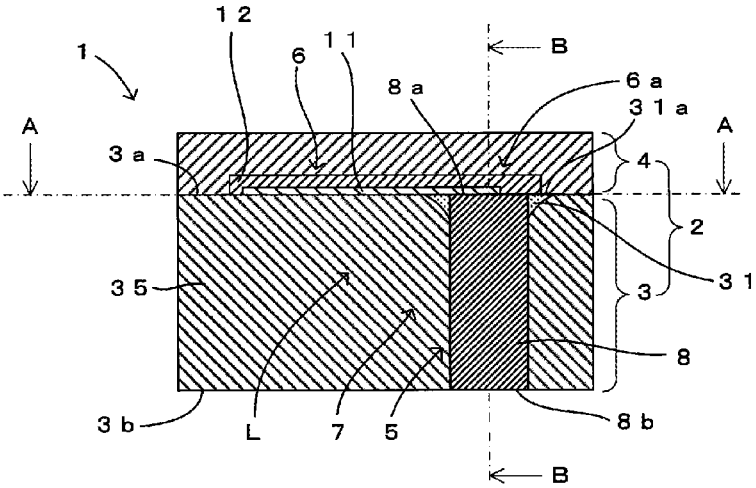
FIG. 2C is a sectional view taken along a line C-C in FIG. 1 when viewed in a direction denoted by arrow.

An inductor component according to a first embodiment of the present disclosure will be described below.

Structure of Inductor Component

A structure of the inductor component is described with reference to FIGS. 1 and 2A to 2C.

As illustrated in FIGS. 1 and 2A to 2C, the inductor component 1 includes an insulator 2, and an inductor L disposed in the insulator 2.

The insulator 2 includes a first resin layer 3, and a second resin layer 4 laminated on the first resin layer 3. The first and second resin layers 3 and 4 are each made of, for example, a magnetic-substance containing resin that is a mixture of an insulating thermosetting resin and a magnetic filler such as ferrite powder. The resin constituting the magnetic-substance containing resin is not limited to the thermosetting type, and the magnetic-substance containing resin may be constituted by employing a photo-curable resin as another example. It is to be noted that the first resin layer 3 corresponds to a "resin insulating layer" in the present disclosure, and that the second resin layer 4 corresponds to a "resin protective layer" in the present disclosure.

The inductor L includes an inductor electrode 7. The inductor electrode 7 includes a first conductor 5 made up of first and second metal pins 8 and 9, and a second conductor 6 (which corresponds to a "connecting conductor" in the present disclosure). The first and second metal pins 8 and 9 are buried in the first resin layer 3 in such a state that their first end surfaces 8*a* and 9*a* are exposed at one principal surface 3*a* of the first resin layer 3, the one principal surface 3*a* opposing to the second resin layer 4, and that their second end surfaces 8*b* and 9*b* are exposed at the other principal surface 3*b* of the first resin layer 3, the other principal surface 3*b* being positioned on the opposite side to the second resin layer 4.

In this embodiment, outer connection terminals (input/output terminals) of the inductor component 1 are formed by the second end surfaces 8*b* and 9*b* of the first and second metal pins 8 and 9, those second end surfaces being exposed at the other principal surface 3*b* of the first resin layer 3. The first and second metal pins 8 and 9 are each made of a material selected from Cu, Cu alloys such as a Cu—Ni alloy and a Cu—Fe alloy, Fe, Au, Ag, Al, etc. Furthermore, the first and second metal pins 8 and 9 are each formed, for example, by shearing a linear metal conductor having a desired diameter and a circular or polygonal sectional shape into a predetermined length.

Thus, the first and second metal pins 8 and 9 of the inductor component 1 are each formed of a metal wire having a predetermined shape and predetermined strength. Stated in another way, each metal pin is a member different from a cured conductive paste or a substance formed with plating growth of a metal material into a predetermined shape. As seen from the above, the first and second metal pins 8 and 9 are each a substitute for a through-hole conductor or a via conductor that is disposed to extend perpendicularly to a top surface and a bottom surface of the insulator.

Alternatively, end portions of the first and second metal pins 8 and 9 on the side closer to the second end surfaces 8*b* and 9*b* may be formed in larger diameter than other portions of the first and second metal pins 8 and 9, respectively, such that the first and second metal pins 8 and 9 are formed in a substantially inverted-T shape when viewed from a side. As another alternative, the end portions of the first and second metal pins 8 and 9 on the side closer to the second end surfaces 8*b* and 9*b* may be formed in an inversely tapered shape gradually increasing in diameter toward the side closer to the second end surfaces 8*b* and 9*b* such that areas of the second end surfaces 8*b* and 9*b* are respectively larger than cross-sectional areas of the other portions of the first and second metal pins 8 and 9, which are buried in the first resin layer 3. In those cases, since the areas of the second end surfaces 8*b* and 9*b* of the first and second metal pins 8 and 9, those second end surfaces functioning as the outer connection terminals, can be increased, contact areas of the first and second metal pins 8 and 9 with a bonding material, such as a solder, can be increased when the inductor component 1 is mounted to, for example, a circuit board of an electronic device.

The first resin layer 3 includes a first covering portion 31 that has a first flat surface 31*a* defining a part of the one principal surface 3*a* of the first resin layer 3, and that covers a peripheral surface of the end portion of the first metal pin 8 on the side closer to the first end surface 8*a*, a third covering portion 32 that has a third flat surface 32*a* defining a part of the one principal surface 3*a* of the first resin layer 3, and that covers a peripheral surface (lateral surface) of the end portion of the second metal pin 9 on the side closer to the first end surface 9*a*, and a body portion 35 that covers respective surfaces of the first covering portion 31 and the third covering portion 32 except for the first and third flat surfaces 31*a* and 32*a*. Moreover, the first covering portion 31 and the third covering portion 32 are formed such that resin thicknesses gradually increase toward the first flat surface 31*a* and the third flat surface 32*a* (namely, in an inversely tapered shape in which widths of the first and third covering portions 31 and 32 gradually increase toward the first and third flat surfaces 31*a* and 32*a*), and that the first covering portion 31 and the third covering portion 32 are formed in a fillet shape at the end portions of the first and second metal pins 8 and 9 on the side close to the first end surfaces 8*a* and 9*a*.

As illustrated in FIG. 1 and FIGS. 2A to 2C, the second conductor 6 having a shape made up of linear lines is formed on the one principal surface 3*a* of the first resin layer 3. The second conductor 6 has a staple-like shape when looked at in a plan view (i.e., a shape made up of a linear central portion, and end portions disposed at both ends of the central portion and extending from both the ends at an angle of 90° with respect to the central portion when looked at in a plan view), and it connects the first end surface 8*a* of the first metal pin 8 and the first end surface 9*a* of the second metal pin 9 to each other. The second resin layer 4 is formed on the one principal surface 3*a* of the first resin layer 3 in a state of covering the second conductor 6.

The second conductor 6 includes an underlying layer 11 formed by coating a conductive paste that contains Cu or Ag, for example, as a metal filler, and a plating layer 12 formed to cover the underlying layer 11. The underlying layer 11 is formed in a state of covering the respective parts of the first end surfaces 8*a* and 9*a* of the first metal pin 8 and the second metal pin 9. The plating layer 12 in the first end portion 6*a* of the second conductor 6 is connected to the first end surface 8*a* of the first metal pin 8, and the plating layer 12 in the second end portion 6*b* of the second conductor 6 is connected to the first end surface 9*a* of the second metal pin 9.

The shape of the second conductor 6 when looked at in a plan view is not limited to the above-described example, and the second conductor 6 may be formed to have another plan shape such as a substantially L-like shape, a linear shape, or a meander shape. Furthermore, the plan shape of the second conductor 6 is not limited to the above-mentioned shape made up of linear lines, and the second conductor 6 may be formed in the shape of a flat plate when looked at in a plan view. In other words, the second conductor 6 may be formed in any suitable plan shape depending on the required magnitude of inductance. Additionally, a part of the plating layer 12, the part covering the underlying layer 11, may be formed of a noble metal, such as Au, instead of Cu.

The second conductor 6 may be formed by metal terminals each having a pin-like shape, an underlying layer formed on a surface of the second resin layer 4, the surface opposing to the first resin layer 3, and a plating layer that covers the underlying layer. In such a case, the second conductor 6 may be connected to each of the first end surface 8*a* of the first metal pin 8 and the first end surface 9*a* of the second metal pin 9 with the aid of ultrasonic vibration. Alternatively, the second conductor 6 may be formed by a metal thin film patterned with photolithography.

Manufacturing Method for Inductor Component

A manufacturing method for the inductor component will be described below. For the sake of easier explanation, the following description is made in connection with an example of manufacturing one piece of inductor component 1. The plurality of inductor components 1 may be manufactured at the same time in a manner of forming the plurality of inductor components 1 together by using the manufacturing method described below, and then separating those inductor components 1 into individual pieces.

1. One Example of Manufacturing Method

One example of the manufacturing method is described with reference to FIGS. 3A to 3G. Each of FIGS. 3A to 3G is a sectional view corresponding to the sectional view taken along the line B-B in FIG. 1 when viewed in a direction denoted by arrow.

Figure 3A:
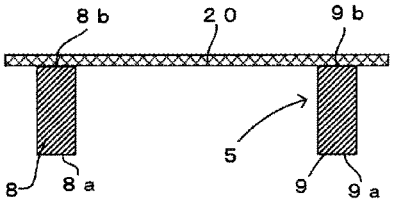
FIGS. 3A to 3G illustrate different steps.

First, as illustrated in FIG. 3A, a transfer plate 20 supporting the second end surfaces 8*b* and 9*b* of the first and second metal pins 8 and 9 at its surface is prepared. An adhesive layer (not illustrated) is formed on the surface of the transfer plate 20 to be capable of supporting the second end surfaces 8*b* and 9*b* of the first and second metal pins 8 and 9. The first and second metal pins 8 and 9 are supported to the surface of the transfer plate 20 by attaching the second end surfaces 8*b* and 9*b* of the first and second metal pins 8 and 9 to the surface of the transfer plate 20 in such a state that the first and second metal pins 8 and 9 are positioned at an interval at which the inductor L of the inductor component 1 can take the desired inductance.

Figure 3D:
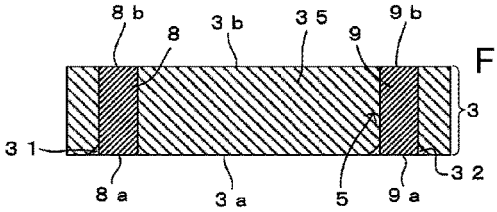
Figure 3B:
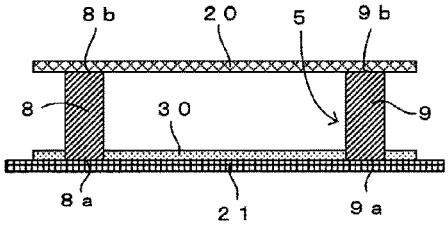

Then, as illustrated in FIG. 3B, a release sheet 21 is prepared. A support layer 30 constituting the first and third covering portions 31 and 32 and being in an uncured state is formed on a surface of the release sheet 21 by coating a magnetic-substance containing resin in a thickness of about 50 to 100 μm, for example. As an alternative, the support layer 30 may be formed by placing a resin sheet, which is fabricated separately, on the release sheet 21. The release sheet 21 may be formed as a composite sheet constituted by a resin sheet of polyethylene terephthalate, polyethylene naphthalate, or polyimide, for example, and by a release layer formed on the resin sheet, or it may be formed of a release sheet having a release function in itself, such as a fluorine resin.

Then, the first and second metal pins 8 and 9 are set to vertically erect at predetermined positions on the surface of the release sheet 21 by inserting the respective end portions of the first and second metal pins 8 and 9, supported by the transfer plate 20, on the side closer to the first end surfaces 8*a* and 9*a* into the support layer 30 until the first end surfaces 8*a* and 9*a* come into contact with the release sheet 21. Thereafter, the support layer 30 is thermally cured. With the thermosetting of the support layer 30, the respective end portions of the first and second metal pins 8 and 9 on the side closer to the first end surfaces 8*a* and 9*a* are supported by the support layer 30.

In the step of thermally solidifying the support layer 30 in the uncured state, the magnetic-substance containing resin forming the support layer 30 is preferably caused to creep over along outer peripheral surfaces of the respective end portions of the first and second metal pins 8 and 9 on the side closer to the first end surfaces 8*a* and 9*a*. Through such a process, the first and third covering portions 31 and 32 (illustrated in FIG. 3C) in the fillet shape, which is formed by the magnetic-substance containing resin having crept over along the outer peripheral surfaces of the respective end portions of the first and second metal pins 8 and 9 on the side closer to the first end surfaces 8*a* and 9*a*, are formed integrally with the support layer 30 after being cured.

Accordingly, support strength of the first and second metal pins 8 and 9 by the support layer 30 after being cured can be increased, and the first and second metal pins 8 and 9 constituting the first conductor 5 can be avoided from tilting or deviating in their positions. Moreover, since the positional deviation, etc. of the first conductor 5 (i.e., the first and second metal pins 8 and 9) is avoided, it is possible to prevent a contact failure between the first conductor 5 and the second conductor 6 when the second conductor 6 is formed on the one principal surface 3*a* of the first resin layer 3 as described later, and hence to prevent disconnection of the inductor electrode 7 and characteristic fluctuations of the inductor L. In addition, when the inductor L is used as an antenna coil, for example, antenna sensitivity can be improved because the first and second metal pins 8 and 9, which are each longer than a metal pin used so far, can be employed as a result of increasing the support strength of the first and second metal pins 8 and 9 by the support layer 30 after being cured.

The fillet shape of the first and third covering portions 31 and 32 can be adjusted by changing the type and the amount of the magnetic-substance containing resin forming the first resin layer 3 (i.e., the insulator 2), or by treating the surfaces of the first and second metal pins 8 and 9 and adjusting wetting properties of those surfaces. Furthermore, adhesion between the first covering portion 31 and the outer peripheral surface of the first metal pin 8 and adhesion between the third covering portion 32 and the outer peripheral surface of the second metal pin 9 can be increased by carrying out a surface roughing process on the outer peripheral surfaces of the respective end portions of the first and second metal pins 8 and 9 on the side closer to the first end surfaces 8*a* and 9*a*.

Figure 3E:
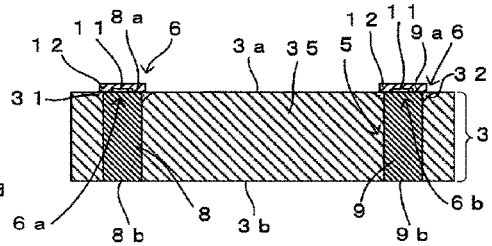
Figure 3C:
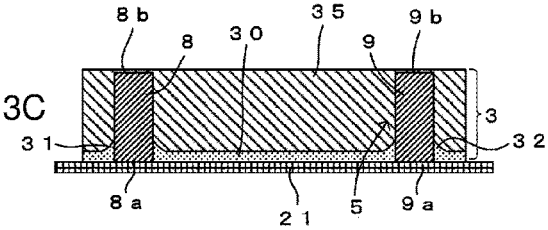

Then, as illustrated in FIG. 3C, the transfer plate 20 is removed, and the body portion 35 of the first resin layer 3, which covers the first and second metal pins 8 and 9, is formed by supplying a magnetic-substance containing resin onto the support layer 30, the magnetic-substance containing resin being the same as that used to form the support layer 30. At that time, since the support layer 30 is cured in a more promoted state than the body portion 35, the occurrence of positional deviation, tilting, etc. of the first and second metal pins 8 and 9 can be avoided when the body portion 35 is formed. Furthermore, since the support layer 30 is cured in the more promoted state, an amount of thermal contraction of the support layer 30 is much smaller than that of the body portion 35. Accordingly, the support layer 30 (specifically, the first and third covering portion 31 and 32) and the respective peripheral surfaces of the first and second metal pins 8 and 9 are maintained in a close contact state. Then, as illustrated in FIG. 3D, after peeling off and removing the release sheet 21, the first end surfaces 8*a* and 8*b* and the second end surfaces 8*b* and 9*b* of the first and second metal pins 8 and 9 are exposed at the surfaces of the first resin layer 3 by removing the resin on front and rear surfaces of the first resin layer 3 with grinding or cutting, and by further removing other part of the support layer 30 than the first and third covering portions 31 and 32 in the fillet shape. As a result, since flatness of each of both the principal surfaces 3*a* and 3*b* of the first resin layer 3 is improved and variations in heights of the first and second metal pins 8 and 9 are suppressed, the inductor electrode 7 can be formed with high accuracy. By removing, in this step, the portion of the support layer 30 except for the first and third covering portions 31 and 32 in the fillet shape, the flat surfaces 31*a* and 32*a* of the first and third covering portions 31 and 32 are exposed at parts of the one principal surface 3*a* of the first resin layer 3, those parts surrounding the first and second metal pins 8 and 9. In the one principal surface 3*a* of the first resin layer 3, plan shapes of the first and third covering portions 31 and 32 are, for example, ring-like shapes with plan shapes of the first and second metal pins 8 and 9 being centers. In addition, the body portion 35 is exposed at parts of the one principal surface 3*a* of the first resin layer 3, those parts surrounding the first and third covering portions 31 and 32.

The body portion 35 of the first resin layer 3 may be formed through the steps of forming the support layer 30 with use of a magnetic-substance containing resin in a liquid phase, and arranging a magnetic-substance containing resin in a solid phase over the support layer 30. As another example, the support layer 30 and the resin layer formed over the support layer 30 may be formed using different types of magnetic-substance containing resins. Here, the different types of magnetic-substance containing resins mean magnetic-substance containing resins in which the contents of magnetic fillers are the same, but the types of magnetic fillers are different, magnetic-substance containing resins in which the types of magnetic fillers are the same, but the contents of magnetic fillers are different, magnetic-substance containing resins in which the contents and the types of magnetic fillers are both different, or magnetic-substance containing resins in which the types of insulating resins are different.

Next, as illustrated in FIG. 3E, the underlying layer 11 of the second conductor 6 having a shape made up of linear lines in a predetermined pattern is formed on the one principal surface 3*a* of the first resin layer 3 with an application process of coating a conductive paste. The plating layer 12 is then formed to cover the underlying layer 11 with a plating process, thereby forming the second conductor 6. Thus, the first end portion 6*a* of the second conductor 6 is connected to the first end surface 8*a* of the first metal pin 8, and the second end portion 6*b* of the second conductor 6 is connected to the first end surface 9*a* of the second metal pin 9, whereby the inductor electrode 7 of the inductor L is formed. The plating layer 12 is formed continuously from the first end portion 6*a* to the second end portion 6*b*. Additionally, the second conductor 6 may also be formed on or in the other principal surface 3*b* of the first resin layer 3 such that the second end surfaces 8*b* and 9*b* of the first and second metal pins 8 and 9 are connected to each other.

Figure 3F:
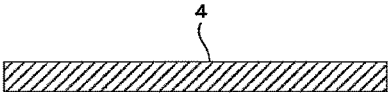
Figure 3G:
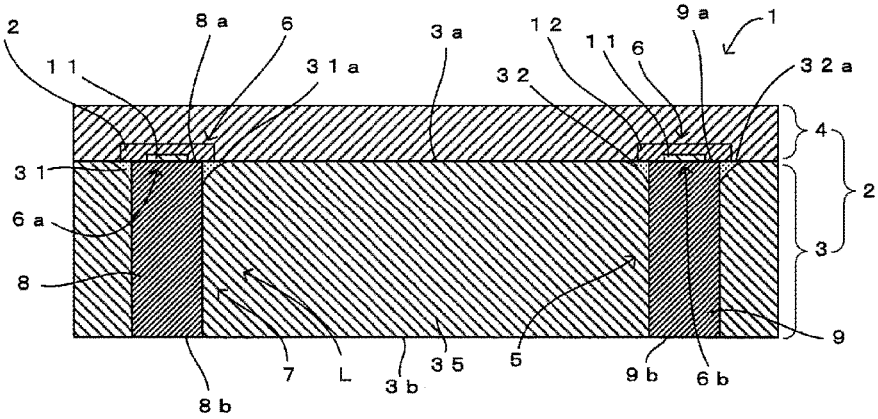

Then, as illustrated in FIG. 3F, the second resin layer 4 constituting the remaining part of the insulator 2 is prepared and laminated on the one principal surface 3*a* of the first resin layer 3 in a state of covering the second conductor 6. As a result, the inductor component 1 is completed. Alternatively, the inductor component 1 may be completed by forming the second resin layer 4 with a process of molding resin. Through the steps described above, it is possible to provide the inductor component 1 including the inductor L of a practical structure, namely the inductor L formed by the first conductor 5 (i.e., the first metal pin 8 and the second metal pin 9) and the second conductor 6.

Heat generated in the regions of the end portions of the first and second metal pins 8 and 9 on the side closer to the first end surfaces 8*a* and 9*a*, those regions defining connection regions between the first and second metal pins 8 and 9 and the second conductor 6, can be efficiently released to the outside through the first and third covering portions 31 and 32 by setting thermal conductivities of the first and third covering portions 31 and 32 to be larger than thermal conductivity of the body portion 35. Moreover, the heat generated in the connection regions between the first and second metal pins 8 and 9 and the second conductor 6 can be further efficiently released to the outside through the second resin layer 4 by setting thermal conductivity of the second resin layer 4, which covers the second conductor 6, to be larger than that of the body portion 35. The thermal conductivities of the first and third covering portions 31 and 32 and of the second resin layer 4 can be adjusted, for example, by changing the material and the amount of the filler contained in the resin.

2. Another Example of Manufacturing Method

Another example of the manufacturing method is described with reference to FIGS. 4A to 4D. Each of FIGS. 4A to 4D is a sectional view corresponding to the sectional view taken along the line B-B in FIG. 1 when viewed in a direction denoted by arrow.

Figure 4A:
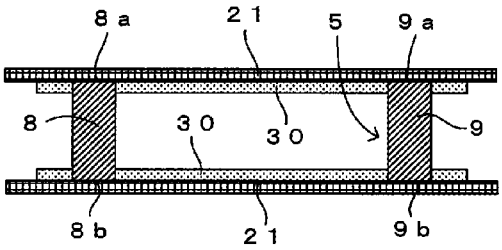
FIGS. 4A to 4D illustrate different steps.
Figure 4B:
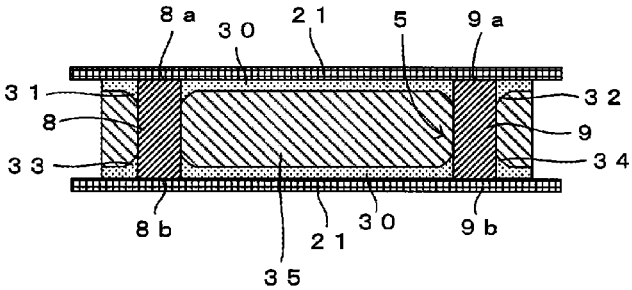
Figure 4C:
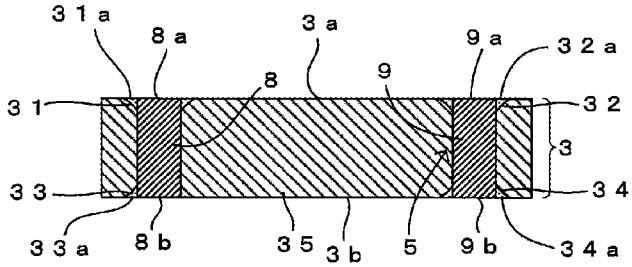
Figure 4D:
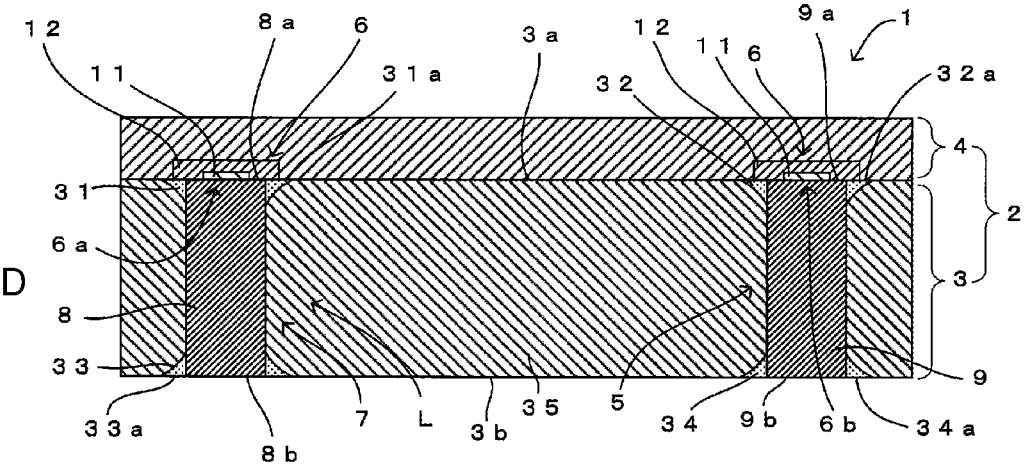

According to the manufacturing method of this example, as illustrated in FIG. 4D, a second covering portion 33 and a fourth covering portion 34 are further formed. The second covering portion 33 has a second flat surface 33*a* defining a part of the other principal surface 3*b* of the first resin layer 3, and covers a peripheral surface of the end portion of the first metal pin 8 on the side closer to the second end surface 8*b*. The fourth covering portion 34 has a fourth flat surface 34*a* defining a part of the other principal surface 3*b* of the first resin layer 3, and covers a peripheral surface of the end portion of the second metal pin 9 on the side closer to the second end surface 9*b*. Moreover, respective surfaces of the second covering portion 33 and the fourth covering portion 34 except for the second and fourth flat surfaces 33*a* and 34*a* are covered with the body portion 35. Similarly to the first covering portion 31 and the third covering portion 32, the second covering portion 33 and the fourth covering portion 34 are formed such that resin thicknesses gradually increase toward the second flat surface 33*a* and the fourth flat surface 34*a*, and that the second covering portion 33 and the fourth covering portion 34 are formed in a fillet shape at the end portions of the first and second metal pins 8 and 9 on the side closer to the second end surfaces 8*b* and 9*b*.

First, as illustrated in FIG. 4A, two release sheets 21 each including the support layer 30 formed thereon are prepared. The first and second metal pins 8 and 9 are set to vertically erect at predetermined positions on one principal surface of one of the release sheets 21 by inserting the respective end portions of the first and second metal pins 8 and 9 on the side closer to the first end surfaces 8*a* and 9*a* into the support layer 30 until the first end surfaces 8*a* and 9*a* come into contact with the one release sheet 21. Furthermore, the first and second metal pins 8 and 9 are arranged at the predetermined positions between the two release sheets 21 by inserting the respective end portions of the first and second metal pins 8 and 9 on the side closer to the second end surfaces 8*b* and 9*b* into the support layer 30 until the second end surfaces 8*b* and 9*b* come into contact with the other release sheet 21. Thereafter, the support layers 30 are thermally cured. With the thermosetting of the support layer 30, the respective end portions of the first and second metal pins 8 and 9 on the side closer to the second end surfaces 8*b* and 9*b* are supported by the support layer 30.

In the step of thermally solidifying the support layers 30 in the uncured state, preferably, the magnetic-substance containing resin forming one of the support layers 30 is caused to creep over along the outer peripheral surfaces of the respective end portions of the first and second metal pins 8 and 9 on the side closer to the first end surfaces 8*a* and 9*a*, and the magnetic-substance containing resin forming the other support layer 30 is caused to creep over along the outer peripheral surfaces of the respective end portions of the first and second metal pins 8 and 9 on the side closer to the second end surfaces 8*b* and 9*b*. Through such a process, the first and third covering portions 31 and 32 in the fillet shape, which are formed by the magnetic-substance containing resin having crept over along the outer peripheral surfaces of the respective end portions of the first and second metal pins 8 and 9 on the side closer to the first end surfaces 8*a* and 9*a*, are formed integrally with the one support layer 30 after being cured. Moreover, the second and fourth covering portions 33 and 34 in the fillet shape, which are formed by the magnetic-substance containing resin having crept over along the outer peripheral surfaces of the respective end portions of the first and second metal pins 8 and 9 on the side closer to the second end surfaces 8*b* and 9*b*, are formed integrally with the other support layer 30 after being cured.

Accordingly, the support strength of the first and second metal pins 8 and 9 by the support layers 30 after being cured can be further increased.

Then, as illustrated in FIG. 4B, the body portion 35 of the first resin layer 3, which covers the first and second metal pins 8 and 9, is formed by supplying a magnetic-substance containing resin to between both the support layers 30, the magnetic-substance containing resin being the same as that used to form the support layers 30. At that time, the support layers 30 are cured in a more promoted state than the body portion 35. Then, as illustrated in FIG. 4C, after peeling off and removing both the release sheets 21, the first end surfaces 8*a* and 8*b* and the second end surfaces 8*b* and 9*b* of the first and second metal pins 8 and 9 are exposed at the surfaces of the first resin layer 3 by removing the resin on the front and rear surfaces of the first resin layer 3 with grinding or cutting, and by further removing the support layers 30.

Next, the underlying layer 11 of the second conductor 6 having a shape made up of linear lines in a predetermined pattern is formed on the one principal surface 3*a* of the first resin layer 3 with an application process of coating a conductive paste. The plating layer 12 is then formed to cover the underlying layer 11 with a plating process, thereby forming the second conductor 6. Thus, the first end portion 6*a* of the second conductor 6 is connected to the first end surface 8*a* of the first metal pin 8, and the second end portion 6*b* of the second conductor 6 is connected to the first end surface 9*a* of the second metal pin 9, whereby the inductor electrode 7 of the inductor L is formed. Additionally, the second conductor 6 may also be formed on or in the other principal surface 3*b* of the first resin layer 3 such that the second end surfaces 8*b* and 9*b* of the first and second metal pins 8 and 9 are connected to each other.

Then, as illustrated in FIG. 4D, the second resin layer 4 constituting the remaining part of the insulator 2 is prepared and laminated on the one principal surface 3*a* of the first resin layer 3 in a state of covering the second conductor 6. As a result, the inductor component 1 is completed. Through the steps described above, it is possible to provide the inductor component 1 including the inductor L of a practical structure, namely the inductor L formed by the first conductor 5 (i.e., the first metal pin 8 and the second metal pin 9) and the second conductor 6.

According to this embodiment, as described above, the first resin layer 3 is formed by forming the first and third covering portions 31 and 32 in close contact with the peripheral surfaces of the respective end portions of the first and second metal pins 8 and 9 on the side closer to the first end surfaces 8*a* and 9*a*, and by forming the body portion 35 in a state of covering the surfaces of the first and third covering portions 31 and 32. Therefore, even when the first resin layer 3 is thermally contracted, boundary regions of the one principal surface 3*a* of the first resin layer 3 around the respective end portions of the first and second metal pins 8 and 9 on the side closer to the first end surfaces 8*a* and 9*a* are filled with the first and third covering portions 31 and 32, and gaps can be prevented from being generated in those boundary regions.

Furthermore, since the resin of the support layer 30 is caused to creep over along the peripheral surfaces of the first and second metal pins 8 and 9 from the side closer to the first end surfaces 8*a* and 9*a* due to wetting, the first and third covering portions 31 and 32 can be easily formed in a close contact state with the peripheral surfaces of the first and second metal pins 8 and 9.

Moreover, since the second and fourth covering portions 33 and 34 are formed in close contact with the peripheral surfaces of the respective end portions of the first and second metal pins 8 and 9 on the side closer to the second end surfaces 8*b* and 9*b*, gaps can be prevented from being generated in the boundary regions of the other principal surface 3*b* of the first resin layer 3 around the respective end portions of the first and second metal pins 8 and 9 on the side closer to the second end surfaces 8*b* and 9*b*.

Second Embodiment

Figure 5:
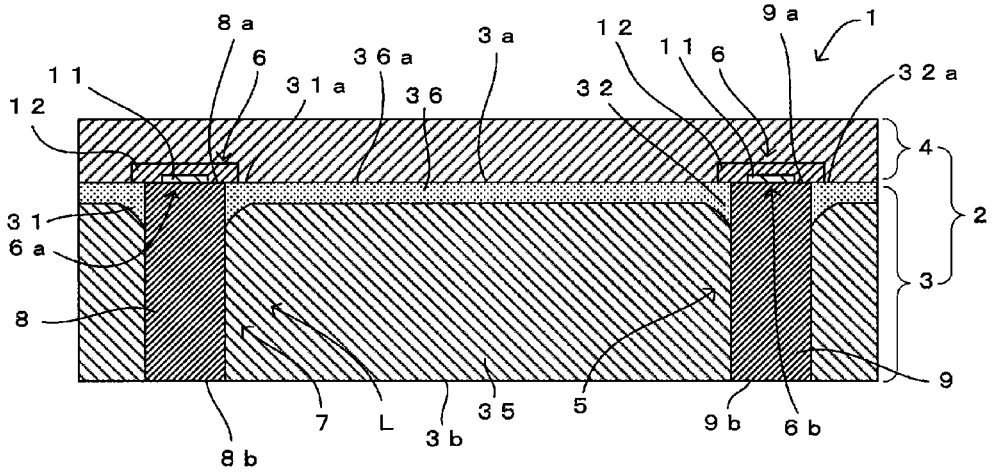
FIG. 5 is a sectional view of an inductor component according to a second embodiment of the present disclosure.

An inductor component 1 according to a second embodiment of the present disclosure will be described below with reference to FIG. 5. FIG. 5 is a sectional view corresponding to the sectional view taken along the line B-B in FIG. 1 when viewed in a direction denoted by arrow.

The inductor component 1 according to the second embodiment is different from the above-described inductor component 1 according to the first embodiment in that, as illustrated in FIG. 5, a coupling portion 36 in the form of a layer, which has a flat surface 36*a* forming the same plane as defined by the first and third flat surfaces 31*a* and 32*a*, and which couples the first and third covering portions 31 and 32 integrally with each other, is formed by partly removing the support layer 30 (see FIG. 3C, etc.). Other constituent elements are similar to those in the above-described first embodiment, and therefore description of the similar constituent elements is omitted by assigning the same reference signs to the corresponding constituent elements.

According to the second embodiment thus constituted, as in the above-described first embodiment, with the presence of the first covering portion 31 and the third covering portion 32 integrally coupled by the coupling portion 36 in the form of a layer, even when the first resin layer 3 is thermally contracted, the boundary regions of the one principal surface 3*a* of the first resin layer 3 around the respective end portions of the first and second metal pins 8 and 9 on the side closer to the first end surfaces 8*a* and 9*a* are filled with the first and third covering portions 31 and 32, and gaps can be prevented from being generated in those boundary regions. It is to be noted that, as in the case of the first and third covering portions 31 and 32 illustrated in FIG. 5, the second and fourth covering portions 33 and 34 illustrated in FIG. 4D may also be formed integrally with each other by a coupling portion.

Third Embodiment

An inductor component according to a third embodiment of the present disclosure will be described below.

Figure 6:
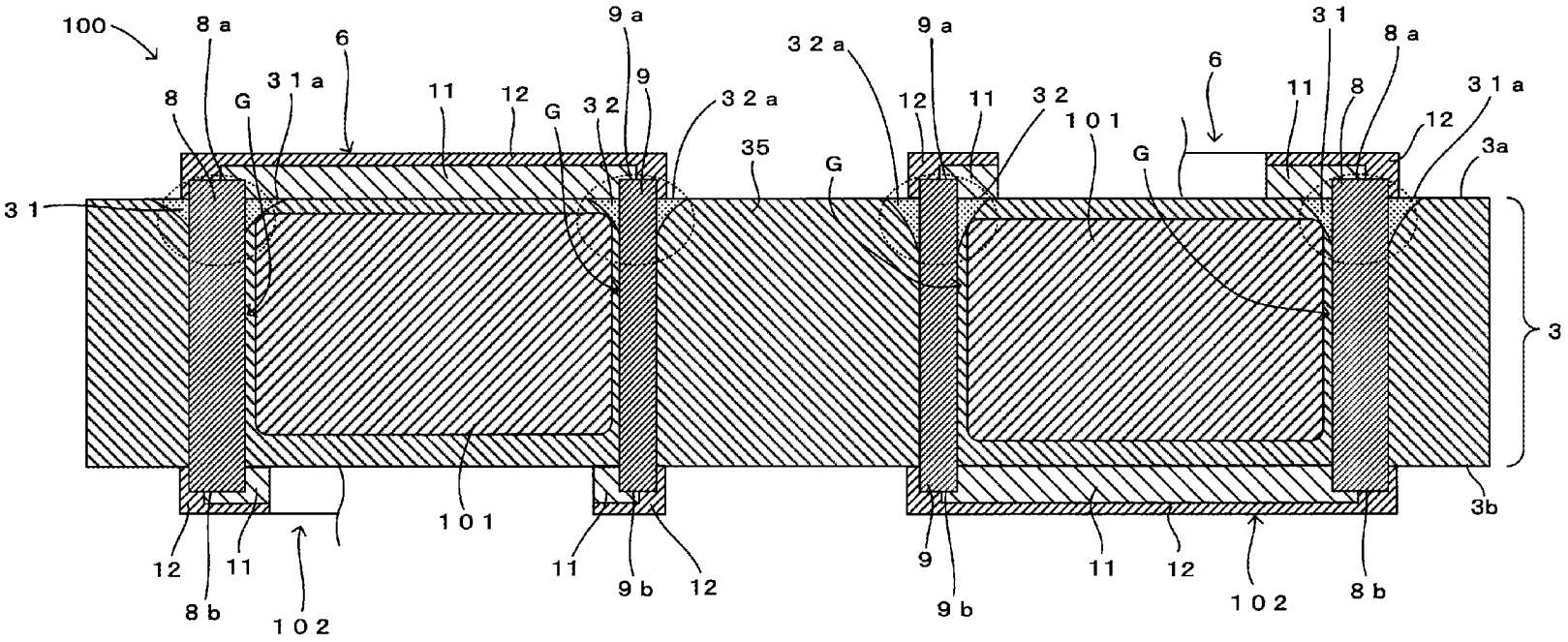
FIG. 6 is a sectional view of an inductor component according to a third embodiment of the present disclosure.
Figure 7:
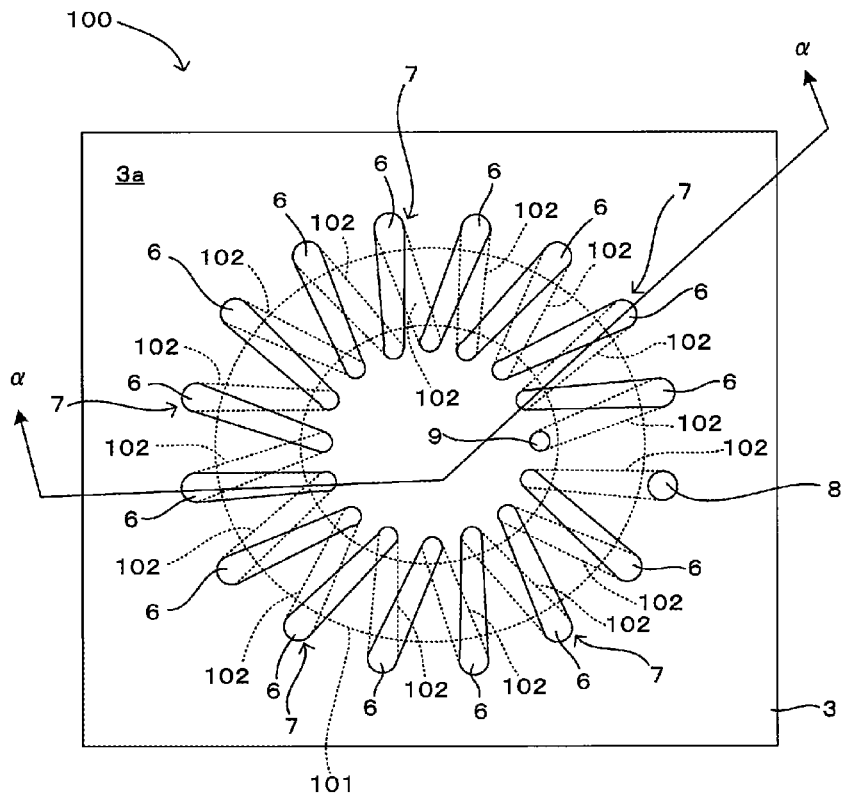
FIG. 7 is an illustration referenced to explain connection states of first and second metal pins that form inductor electrodes.
Figure 10:
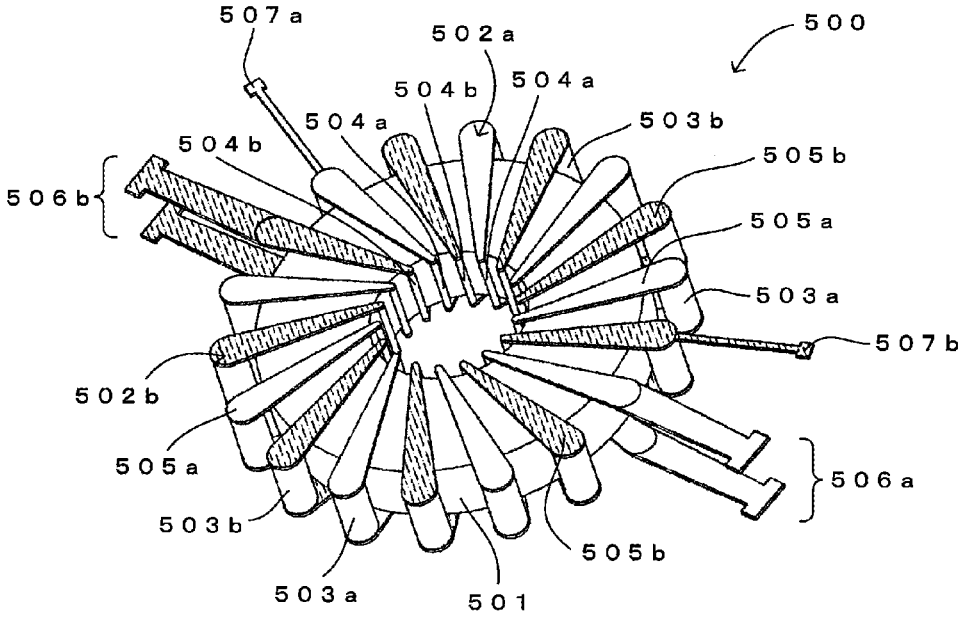
FIG. 10 illustrates an inductor component of related art.

A basic structure of an inductor component 100 is described with reference to FIGS. 6 and 7. FIG. 7 is a plan view illustrating a state of the inductor component 100 of FIG. 6 when viewed from above in a direction facing the drawing sheet. FIG. 6 is a sectional view taken along a line α-α in FIG. 7 when viewed in a direction denoted by arrow.

The inductor component 100 according to the third embodiment is different from the inductor component 1 illustrated in FIG. 1 in that, as illustrated in FIGS. 6 and 7, the inductor component 100 includes a coil core 101 arranged between the first metal pin 8 and the second metal pin 9 and buried in the body portion 35 of the first resin layer 3. In the following, different points from the first embodiment are primarily described, and detailed description of similar constituent elements to those in the first embodiment is omitted while the same reference signs are assigned to the corresponding constituent elements.

As illustrated in FIGS. 6 and 7, the coil core 101 has an annular shape, and the plurality of inductor electrodes 7 are arrayed along a circumferential direction of the coil core 101. The inductor electrodes 7 are each constituted such that the first metal pin 8 is arranged on the outer peripheral side of the coil core 101, that the second metal pin 9 is arranged on the inner peripheral side of the coil core 101, and that the first end surfaces 8*a* and 9*a* of the first and second metal pins 8 and 9 are connected to each other by the second conductor 6. Furthermore, the second end surface 8*b* of the first metal pin 8 of one inductor electrode 7 and the second end surface 9*b* of the second metal pin 9 of another inductor electrode 7, which is adjacent to the one inductor electrode 7 on the predetermined side (on the "clockwise side" in this embodiment), are connected to each other by corresponding one of a plurality of third conductors 102 each having a linear shape. Thus, in the inductor component 100, an inductor L formed by the plurality of inductor electrodes 7 arranged in a surrounding relation to the coil core 101 is disposed in the first resin layer 3.

The third conductors 102 are each formed on or in the other principal surface 3*b* of the first resin layer 3 in a similar structure to that of the second conductor 6. More specifically, the third conductor 102 is formed by the underlying layer 11 and the plating layer 12 covering the underlying layer 11. Moreover, the corresponding second end surfaces 8*b* and 9*b* of the first and second metal pins 8 and 9 are directly connected to each other by the plating layer 12 of the third conductor 102.

The first and second metal pins 8 and 9 constituting both ends of the inductor L are each used as a terminal for taking out a signal. Furthermore, in this embodiment, the first resin layer 3 is made of a general thermosetting resin, such as an epoxy resin, which contains no magnetic filler. As in the above-described first embodiment, materials of the first resin layer 3 are not limited to the thermosetting resin, such as the epoxy resin. The second resin layer 4 serving as a resin protective layer may be formed, as required, on each of both the principal surfaces 3*a* and 3*b* of the first resin layer 3.

As illustrated in regions surrounded by dotted lines in FIG. 6, edges of the coil core 101 are held in contact with outer peripheral surfaces of the first and third covering portions 31 and 32, whereby gaps G are formed between the first and second metal pins 8 and 9 and the coil core 101. With the above-described structure, the first and second metal pins 8 and 9 can be avoided from coming into contact with the coil core 101. Although the edges of the coil core 101 are chamfered in an example illustrated in FIG. 6, the edges of the coil core 101 are not always required to be chamfered. Moreover, in this embodiment, the coil core 101 having a doughnut-like shape is formed such that a width of a portion of the coil core 101 around which the inductor electrodes 7 are wound spirally is narrower than a spacing between an array of the first metal pins 8 and an array of the second metal pins 9.

Alternatively, the second end surfaces 8*b* and 9*b* of the first and second metal pins 8 and 9 may be connected to each other by the second conductor 6, and the first end surfaces 8*a* and 9*a* thereof may be connected to each other by the third conductor 102. Furthermore, as in the inductor component 1 illustrated in FIG. 4D, the second and fourth covering portions 33 and 34 may be formed in the first resin layer 3 on the side closer to the second end surfaces 8*b* and 9*b* of the first and second metal pins 8 and 9. Moreover, the coupling portion 36 may be disposed as in the inductor component 1 according to the second embodiment illustrated in FIG. 5.

The inductor component 100 can be manufactured by employing any of the manufacturing methods that have been described with reference to FIGS. 3A to 3G and 4A to 4D. As one example, the manufacturing method illustrated in FIGS. 3A to 3G may be modified as follows. In the step illustrated in FIG. 3A, a predetermined region having substantially the same shape as that of the coil core 101 when looked at in a plan view is set on the transfer plate 20, and the plurality of first conductors 5 are arranged along the predetermined region in a state sandwiching the predetermined region by the first and second metal pins 8 and 9. In the next step illustrated in FIG. 3B, after transferring the first conductors 5 onto the release sheet 21 from the transfer plate 20 and solidifying the resin of the support layer 30 to form the first and third covering portions 31 and 32, the coil core 101 is placed between the first and second metal pins 8 and 9. In the step illustrated in FIG. 3C, the body portion 35 of the first resin layer 3 is formed.

As another example, the manufacturing method illustrated in FIGS. 4A to 4D may be modified as follows. In the step illustrated in FIG. 4A, a predetermined region having substantially the same shape as that of the coil core 101 when looked at in a plan view is set on one release sheet 21 (on the upper side in the example illustrated in FIG. 4A), and the plurality of first conductors 5 are arranged along the predetermined region in a state sandwiching the predetermined region by the first and second metal pins 8 and 9. Then, after solidifying the resin of the support layer 30 on the one release sheet 21 to form the first and third covering portions 31 and 32, the coil core 101 is placed between the first and second metal pins 8 and 9. Thereafter, the respective end portions of the first and second metal pins 8 and 9 on the side closer to the second end surfaces 8*b* and 9*b* are arranged to be positioned in the support layer 30 on the other release sheet 21. Then, after solidifying the resin of the support layer 30 on the other release sheet 21 to form the second and fourth covering portions 33 and 34, the body portion 35 of the first resin layer 3 is formed in the step illustrated in FIG. 4B.

In addition, the manufacturing methods described with reference to FIGS. 3A to 3G and 4A to 4D may be modified such that, in the final steps of those manufacturing methods, the plurality of third conductors 102 are formed on the other principal surface 3*b* of the first resin layer 3, and that the corresponding second end surfaces 8*b* and 9*b* of the first and second metal pins 8 and 9 are connected to each other by the third conductors 102.

Modification of Coil Core

While the above description has been made in connection with an example in which the coil core 101 is of the annular toroidal type, the shape of the coil core is not limited to the toroidal shape. Coil cores having various shapes can be optionally employed as represented, for example, by a coil core 111 having a linear shape illustrated in FIG. 8A, and a coil core 121 having a substantially C-like shape illustrated in FIG. 8B. Thus, FIGS. 8A and 8B illustrate modifications of the coil core and indicates positional relations among the coil core 111 or 121 and the first and second metal pins 8 and 9 within the first resin layer 3.

According to this embodiment, as described above, since the coil core 101, 111 or 121 is arranged between the first and second metal pins 8 and 9, an inductance of the inductor L included in the inductor component 100 can be increased. Furthermore, coils having various functions, such as a common mode noise filter and a choke coil, can be constituted by utilizing the inductor electrodes 7 that are included in the inductor component 100. Materials of the coil core 101, 111 or 121 may be of any suitable type. Thus, the coil core 101, 111 or 121 may be made of a general magnetic material, such as iron or ferrite.

While, in the inductor component 100 illustrated in FIG. 6, both the ends of each of the first and second metal pins 8 and 9 are exposed in a state projecting out from the first resin layer 3, the inductor component 100 may be constituted such that only both the end surfaces 8*a*, 8*b*, 9*a* and 9*b* of each of the first and second metal pins 8 and 9 are exposed from the first resin layer 3. Thicknesses, lengths, etc. of the first and second metal pins 8 and 9 may be changed as appropriate depending on the demanded configurations of the inductor component 100.

Fourth Embodiment

An inductor component according to a fourth embodiment of the present disclosure will be described below.

A basic structure of an inductor component 200 is described below with reference to FIG. 9. The inductor component 200 (inductor array) according to this embodiment is different from the inductor component 1 illustrated in FIG. 1 in that, as illustrated in FIG. 9, the plurality (six in this embodiment) of inductors L are constituted in the form of an integral unit by arraying those inductors L within the insulator 2. The inductor component 200 can be manufactured by employing any of the manufacturing methods that have been described with reference to FIGS. 3A to 3G and 4A to 4D, but detailed description of the manufacturing method for the inductor component 200 is omitted. Other constituent elements are similar to those in the above-described first embodiment, and therefore description of the similar constituent elements is omitted by assigning the same reference signs to the corresponding constituent elements.

It is to be noted that the present disclosure is not limited to the above embodiments. In other words, the present disclosure can be modified in various ways in addition to the above embodiments insofar as not departing from the gist of the present disclosure, and constituent elements in the above embodiments may be optionally combined with each other. For instance, the shapes of the first and second metal pins 8 and 9 are not limited to the linear shape, and they may be formed in a circular-arc shape or may be bent into a crank-like shape, for example.

The above-described inductor component can be used as a constituent element of a noise suppression circuit, a matching circuit, a power supply circuit, etc. Moreover, the inductor component can be used as an antenna module for an RF-ID (Radio Frequency-Identification), for example, in the case of constituting an antenna coil with the inductor electrodes. The inductor component can be further used as an antenna communication module in the case of mounting an IC chip for communication to the inductor component.

The present disclosure can be widely applied to inductor components each including an inductor disposed on or in a resin insulating layer.

1, 100, 200 inductor component
3 first resin layer (resin insulating layer)
3*a* one principal surface
3*b* other principal surface
31 first covering portion
31*a* first flat surface
32 third covering portion
32*a* third flat surface
33 second covering portion
33*a* second flat surface
35 body portion
36 coupling portion
36*a* flat surface
4 second resin layer (resin protective layer)
6 second conductor (connecting conductor)
8 first metal pin
9 second metal pin
8*a*, 9*a* first end surface
8*b* second end surface
101, 111, 121 coil core
L inductor

The invention claimed is:

1. An inductor component comprising:
a resin insulating layer; and
an inductor including a first metal pin buried in the resin insulating layer,
wherein a first end surface of the first metal pin is exposed at one principal surface of the resin insulating layer,
wherein the resin insulating layer includes a first covering portion and a body portion,
wherein the first covering portion covers a part of a lateral surface of the first metal pin positioned close to the first end surface of the first metal pin, and has a first flat surface exposed at a part of the one principal surface of the resin insulating layer surrounding the first end surface of the first metal pin,
wherein the body portion covers a surface of the first covering portion except for the first flat surface,
wherein the first covering portion has a thickness gradually increasing toward the first flat surface, and
wherein a resin of the first covering portion is more cured than a resin of the body portion.

2. The inductor component according to claim 1, wherein the first metal pin is buried in the resin insulating layer with a second end surface of the first metal pin being exposed at another principal surface of the resin insulating layer, and the resin insulating layer further includes a second covering portion, wherein the second covering portion covers a part of the lateral surface of the first metal pin positioned close to the second end surface of the first metal pin, and has a second flat surface exposed at a part of the other principal surface of the resin insulating layer surrounding the second end surface of the first metal pin, and wherein the body portion covers a surface of the second covering portion except for the second flat surface.

3. The inductor component according to claim 1, wherein a thermal conductivity of the first covering portion is larger than a thermal conductivity of the body portion.

4. The inductor component according to claim 1, wherein the inductor further includes a second metal pin and a connecting conductor, wherein the second metal pin is buried in the resin insulating layer with a first end surface of the second metal pin being exposed at the one principal surface of the resin insulating layer, and wherein the connecting conductor is arranged on or in the one principal surface of the resin insulating layer, and is connected to the first end surface of the first metal pin and the first end surface of the second metal pin.

5. The inductor component according to claim 4, further comprising a resin protective layer provided on the one principal surface of the resin insulating layer in a state of covering the connecting conductor, wherein a thermal conductivity of the resin protective layer is larger than a thermal conductivity of the body portion.

6. The inductor component according to claim 4, further comprising a coil core arranged between the first metal pin and the second metal pin, and buried in the body portion.

7. The inductor component according to claim 4, wherein the resin insulating layer further includes a third covering portion and a coupling portion, wherein the third covering portion covers a part of a lateral surface of the second metal pin positioned close to the first end surface of the second metal pin, and has a third flat surface exposed at a part of the one principal surface of the resin insulating layer surrounding the first end surface of the second metal pin, and wherein the coupling portion is in form of a layer, has a flat surface flush with the first flat surface and the third flat surface, and integrally couples the first covering portion with the third covering portion.

8. The inductor component according to claim 1, wherein the body portion is exposed at a part of the one principal surface of the resin insulating layer surrounding the first flat surface of the first covering portion.

9. The inductor component according to claim 2, wherein a thermal conductivity of the first covering portion is larger than a thermal conductivity of the body portion.

10. The inductor component according to claim 2, wherein the inductor further includes a second metal pin and a connecting conductor, wherein the second metal pin is buried in the resin insulating layer with a first end surface of the second metal pin being exposed at the one principal surface of the resin insulating layer, and wherein the connecting conductor is arranged on or in the one principal surface of the resin insulating layer, and is connected to the first end surface of the first metal pin and the first end surface of the second metal pin.

11. The inductor component according to claim 3, wherein the inductor further includes a second metal pin and a connecting conductor, wherein the second metal pin is buried in the resin insulating layer with a first end surface of the second metal pin being exposed at the one principal surface of the resin insulating layer, and wherein the connecting conductor is arranged on or in the one principal surface of the resin insulating layer, and is connected to the first end surface of the first metal pin and the first end surface of the second metal pin.

12. The inductor component according to claim 5, further comprising a coil core arranged between the first metal pin and the second metal pin, and buried in the body portion.

13. The inductor component according to claim 5, wherein the resin insulating layer further includes a third covering portion and a coupling portion, wherein the third covering portion covers a part of a lateral surface of the second metal pin positioned close to the first end surface of the second metal pin, and has a third flat surface exposed at a part of the one principal surface of the resin insulating layer surrounding the first end surface of the second metal pin, and wherein the coupling portion is in form of a layer, has a flat surface flush with the first flat surface and the third flat surface, and integrally couples the first covering portion with the third covering portion.

14. The inductor component according to claim 6, wherein the resin insulating layer further includes a third covering portion and a coupling portion, wherein the third covering portion covers a part of a lateral surface of the second metal pin positioned close to the first end surface of the second metal pin, and has a third flat surface exposed at a part of the one principal surface of the resin insulating layer surrounding the first end surface of the second metal pin, and wherein the coupling portion is in form of a layer, has a flat surface flush with the first flat surface and the third flat surface, and integrally couples the first covering portion with the third covering portion.

15. An inductor component comprising:

a resin insulating layer; and an inductor including a first metal pin buried in the resin insulating layer, wherein a first end surface of the first metal pin is exposed at one principal surface of the resin insulating layer, wherein the resin insulating layer includes a first covering portion and a body portion, wherein the first covering portion contacts and partially covers a lateral surface of the first metal pin at a position close to the first end surface of the first metal pin, and has a first flat surface exposed at a part of the one principal surface of the resin insulating layer surrounding the first end surface of the first metal pin, wherein the body portion covers a surface of the first covering portion except for the first flat surface, and wherein a resin of the first covering portion is more cured than a resin of the body portion.

16. The inductor component according to claim 15, wherein the body portion contacts and partially covers the lateral surface of the first metal pin at a position away from the first end surface of the first metal pin.

* * * * *